United States Patent [19]

Brown

[11] 4,024,981

[45] May 24, 1977

[54] EASY-OPEN ECOLOGY END

[75] Inventor: Omar L. Brown, Dayton, Ohio

[73] Assignee: Ermal C. Fraze, Dayton, Ohio

[22] Filed: July 1, 1976

[21] Appl. No.: 701,976

[52] U.S. Cl. ..... 220/269

[51] Int. Cl.[2] ..... B65D 41/32

[58] Field of Search ..... 220/268–273, 220/277

[56] References Cited

UNITED STATES PATENTS

| | | | |
|---|---|---|---|
| 3,843,011 | 10/1974 | Perry | 220/269 X |
| 3,967,752 | 7/1976 | Cudzik | 220/269 |
| 3,977,561 | 8/1976 | Strove et al. | 220/269 |

*Primary Examiner*—George T. Hall

*Attorney, Agent, or Firm*—George F. Smyth

[57] ABSTRACT

An improved easy-opening end structure includes a retained tab and a captured, retained panel, the latter defined by a scoreline and forming a pour opening upon fracture of the scoreline. The tab is fixed to the end wall, other than to the panel, and includes an opening end positioned over the panel and a lifting end spaced from the panel. The panel is connected by a retaining strip to the end wall, the retaining strip being formed between scoreline segments which are laterally located relative to the rivet. The rivet is surrounded by a rivet well of reduced thickness of material, a portion of the scoreline passing through the rivet well, while a coined formation defining a transition zone extends laterally of the rivet and overlies the portion of the scoreline located laterally of the rivet. The panel includes a depression formed therein forward of the retaining strip and located between the ends of a bead which is formed in the panel. The end wall also includes a bead which terminates in coined end sections, the end wall bead surrounding a portion of the scoreline and the coined sections being spaced on each side of the rivet. The tab operates to effect opening of the end structure by fracturing the portion of the scoreline forward of the rivet and thereafter bearing against the panel to effect progressive rupture of the scoreline by essentially a class 1 lever action, and to push the panel downwardly and laterally through the formed opening. The panel is joined to the end wall by the retaining strip and subsequent to rupture of the panel, the tab may be pushed back against the end wall and retained thereon.

26 Claims, 11 Drawing Figures

FIG. 1
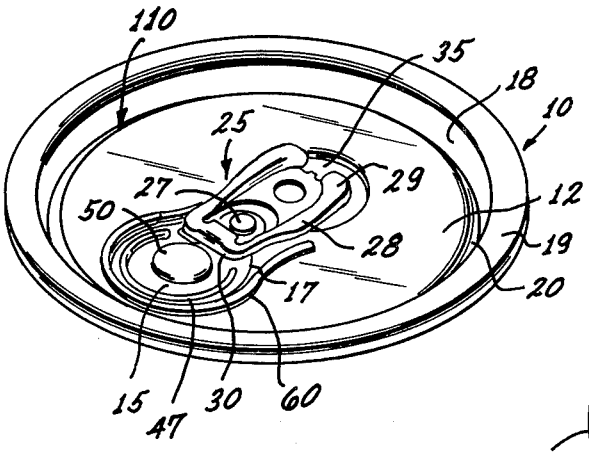
FIG. 2
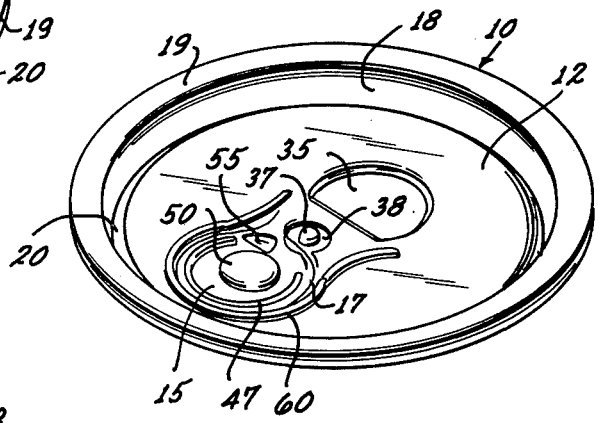
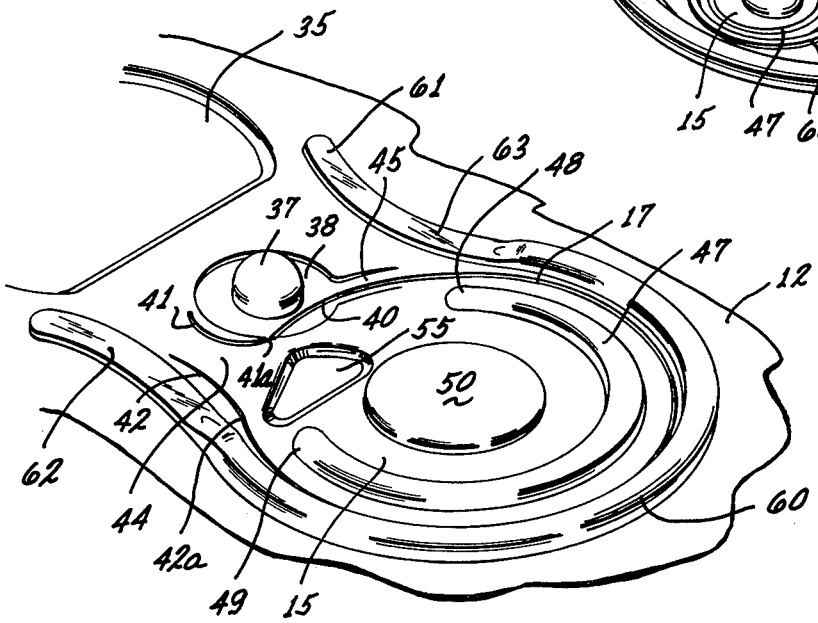
FIG. 3
FIG. 4
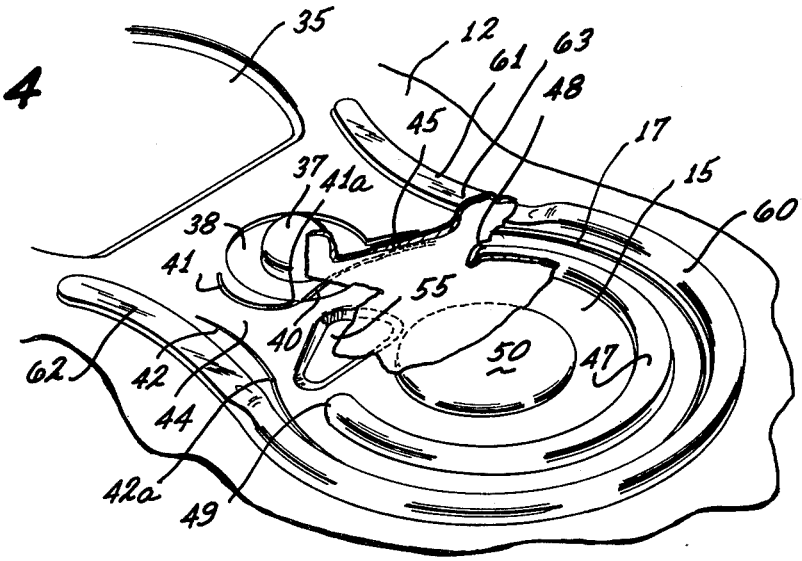

FIG. 5
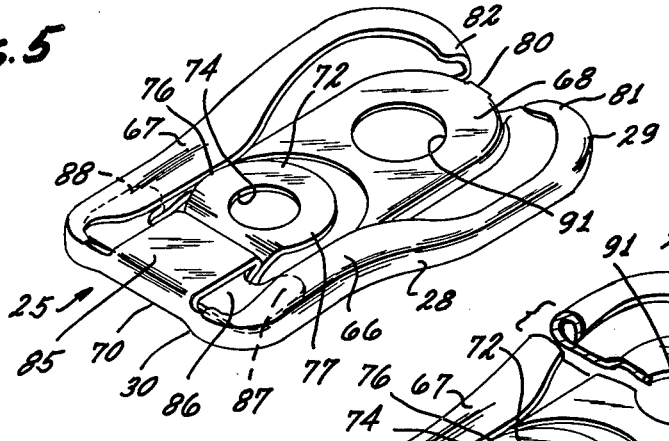
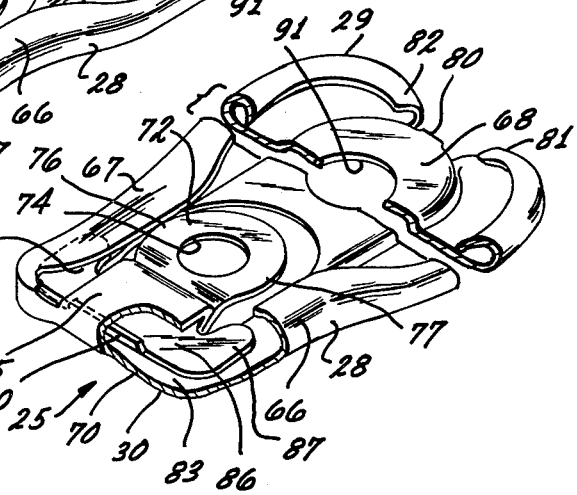
FIG. 6
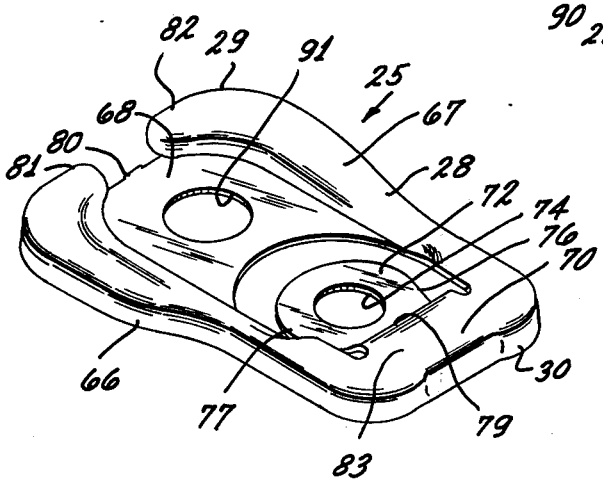
FIG. 7
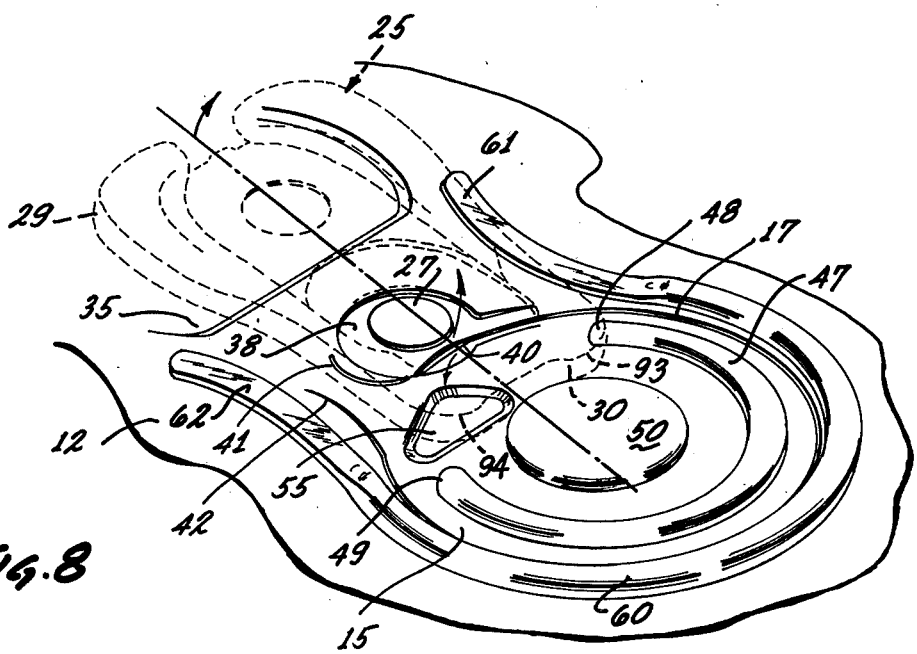
FIG. 8

EASY-OPEN ECOLOGY END

BACKGROUND OF THE INVENTION

This invention relates to an easy-opening container end wall, and more specifically to an improved easy-opening end wall having a retained tab member operative to form an opening in the end wall by rupture of a tear opening, the ruptured tear portion or panel being retained by a retaining strip, the end structure having bead formations on the end wall and panel and a deformation in the panel to assist in progressive rupture of the scoreline.

This application describes an easy-opening end structure which is an improvement over the end structures described and claimed in U.S. Application Ser. No. 608,044, filed on Aug. 27, 1975, and U.S. Application Ser. No. 670,084, filed Oct. 15, 1975, and assigned to the same assignee.

The ready acceptance of easy-opening containers has resulted in extended use of this type container for a substantial number of canned products, especially beverages, such as beer, soft drinks, and the like. This type of container, in the form of a can, is characterized by a lever or tab permanently joined to a tear strip, the latter being separable from the can top to provide a pouring spout. In the form heretofore used, the tab or top is ruptured along a continuous scoreline and the pull tab and tear strip are removed as a unit and normally discarded.

The convenience of easy-opening cans has created problems because of the unfortunate and indiscriminate disposal of the severed portion of the can top. For example, beach and picnic areas have an accumulation of litter in the form of tabs and tear strips which have been removed from easy-opening cans. These discarded tabs and tear strips are quite difficult to clean up because they are small and thus pass through the tines of a rake. Being made normally of aluminum, they cannot be collected by magnetic means. Nonetheless, this type of can is widely used and it is definitely advantageous to provide a solution to the problem of littering while still providing to the public the convenience of the easy-opening cans.

The numerous advantages incident to the use of easy-opening cans has given rise to an industry which has developed to the point where standard procedures and equipment are now in widespread use. For example, many of the machines now used to form the end wall of a container include five stations in which various operations are performed to provide an end unit for a container. By way of example, the first station usually forms the "bubble," transformed into a button or rivet in the second station, followed by scoring in the third station. In the fourth station any embossing of logo or other information in the container end is carried out, and in the fifth station the tab is attached, i.e. staked to the end unit by the rivet.

Those in the industry are aware of the need to provide convenience containers of the easy-opening type which overcome the problems of indiscriminate disposal of tabs and tear strips from an ecological standpoint. The provision of a solution to this problem, is somewhat complicated by the fact that whatever end is designed, it is desired that the end be one capable of being made on machines presently in use and which can be modified by changes of tooling in each of the stations generally used in the formation of the end wall without the need to add additional stations. If, for example, an end is designed which requires more than five separate operations in a five station machine, there are practical problems in bringing such an end into commerce because of the need to replace or to rebuild substantially the presently existing equipment in order to add one or more stations. Thus, any structure of an end wall which can be considered an acology end from the standpoint of having some form of retained tab or tear strip or both and which can be made on currently existing machines with modified tooling at each of the currently existing stations has definite advantages.

Moreover, it is fairly recognized at present that standards have been established with respect to the length and diameter of the component parts and the gauge of materials used in the packaging industry, particularly the soft drink and beverage industry. Thus, in the design of a container end wall intended to form an easy-opening end wall for use in the beer and beverage industry, it is desirable to maintain the dimensions of any new structure fairly within the dimensions currently in use in those respective industries.

One of the difficulties which arises in the provision of an end having substantial improvements from the standpoint of ecology is the mode of opening of the end wall. For example, the user has been accustomed to lifting the end of the tab in order to effect rupture of the tear strip. Thus, with certain types of end wall structures presently being marketed and which include push button panels, some user confusion has existed because the structure of the end wall does not include the tab. While the structure just described is intended to be opened by pushing down on the scored button to rupture the same, some users are confused by the absence of any tab or lever.

Another aspect in the provision of an easy-opening end structure which has ecological advantages is the variety of products present in the container with which the end wall is to be used. By way of example, it is known that the internal pressure in the container may vary depending upon the type of product within the container as well as the processing during packaging. For example, some beverages are packaged under considerable pressure, in some cases as much as 50 to 80 psi while other products are packaged at a somewhat lesser pressure. The packaged completed container must then be capable of withstanding substantial pressures as might be generated if the container is exposed to direct sunlight which tends to increase the internal pressure within the container. For example in some operations, the can is sealed and pasteurized resulting in the generation of internal pressure within the can.

Thus, it is definitely advantageous to be able to provide a container end structure which has wide applicability insofar as the various conditions involved in packaging the product within the container. Thus, the usual procedure is to attempt to provide a container end wall capable of withstanding the most rigorous conditions required by the industy such that a single design of end may be used over a wide variety of products. Moreover, there is the added requirement that the end structure be capable of manufacture at the usual high rates currently employed by the container industry with the quipment presently used, subject to the change of tooling necessary to adapt the presently existing multiple station machines in order to produce any new and improved end.

In summary, there are constraints within which the industry operates both from the standpoint of the standards which have been adopted, the cost of changeover and the desire to provide an end structure which is satisfactory from the standpoint of reducing the litter which has accumulated by virtue of separable tabs and tear strips.

DESCRIPTION OF THE PRIOR ART

One approach in solving the ecology problems has been to provide a container end structure with a retained tab and tear strip, as for example in U.S. Pat. No. 3,757,989 of Sept. 11, 1973. In that structure, the tab is attached to the tear strip and the tear strip is retained on the end structure subsequent to rupture of the scoreline.

Another approach is described in U.S. Pat. No. 3,795,342 of Mar. 5, 1974, in which the tab is retained with the end structure and folded in a stowing location subsequent to rupture of the tear strip.

There is still another approach to the problem as described in U.S. Pat. No 3,446,389, of May 27, 1969, in which a tab is attached to the end wall of the container such that the nose thereof overlies a rupturable panel. Upon lifting of the free end of the tab, the scoreline is ruptured, by a shear type force, so as to form two panel sections which are forced downwardly into the container and out of the way. The tab is then pushed back against the end wall.

U.S. Pat. No. 3,826,401 of July 30, 1974, shows an opening member in the form of a lever which is operative to rupture a scoreline laterally disposed with respect to the rivet, the lever being permanently attached to the end wall.

U.S. Pat. No. 3,853,242, of Dec. 10, 1974, describes a lever member affixed to the end wall in which the lever member includes a panel piercing portion and a finger grasping portion. The lever is rotatable in a plane normal to the panel to rupture a weakening line.

U.S. Pat. No. 3,807,597 of Apr. 30, 1974, describes an end structure for a container including an opening member which is movable from a non-use position into alignment with a scored section.

Push button panel type container end walls are known in which the removable panel is manually pushed into the container, see for example U.S. Pat. No. 3,886,881 of June 3, 1975.

In the main, however, most easy-open containers includes an end structure which is the tear strip severed by manipulation of the tab to form a pour opening. In this type of container, shown for example in U.S. Pat. No. 3,723,744 of Sept. 20, 1966, the tab acts as a class 2 lever in its opening action, the rivet being in the tear out panel while the portion of the scoreline initially ruptured is between the lifting end of the tab and the rivet.

Also known in the art are end structures in which the tab operates as a class 1 lever, i.e. the rivet is between the lifting end and the scoreline and the nose of the tab operates to rupture the scoreline, as for example in U.S. Pat. No. 3,446,389 supra.

A class 2 lever tab effects rupture basically by a liting action, definitely an advantage where the packaged goods are under pressure since the opening action does not oppose the internal container pressure. In the prior art class 2 lever tabs, the front end of the tab bears against the end wall other than in the pour opening defined by the scoreline. In a class 1 lever type tab, the opening action is downward and, if the container is under pressure, there is a tendency for the internal pressure of the container to act in opposition to the opening action.

One of the structures being considered from the ecology point of view uses a lanced tab, for example as shown in U.S. Pat. No. 3,406,867 of Oct. 22, 1968, affixed by a rivet to and end wall. The forward nose of the tab overlies a circular raised bead located in the general central area of a scored section which forms the pour opening. The scoreline is non-circular in shape, includes a hinge, and the tab is affixed in the center of the end structure, generally along the center line of the end with the pour opening adjacent to the chuck wall and in line with the tab. The panel is pivoted sharply around the hinge formed between the ends of a principal scoreline in the form of a combined antifracture scoreline joined to the principal scoreline by loops which are spaced to form a hinge therebetween.

United States Applications Ser. No. 608,044 and 670,084, above identified, represent another approach to the problem and the end structure therein described with a hinged panel are a substantial improvement over prior devices for the reason therein described. The present invention represents an improved end structure over those described in the above applications.

End structures are known which include a hinge whose location is fixed by the scoreline which forms the pour panel. Normally the scoreline is interrupted, in the sense that there is an unscored area between spaced ends of the principal scoreline, the hinge being in that portion of the end structure through which the principal scoreline would extend if it were continuous. The space between the ends of the principal scoreline forms the axis of a hinge so that the panel folds about the hinge line which is generally an unscored area between the ends of the principal scoreline.

With a hinge the location of panel is fixed, i.e. it folds sharply around an unscored area which is basicaly an unscored segment of the principal scoreline. Thus the panel is adjacent to the opening and unless folded back to the underside of the end, it can be reached by the user. Moreover, such a hinge represents a sharp end of perhaps 90° or more. If the hinge line is oriented parallel to the grain axis of the material forming the end wall, the normally small hinge, adjacent to the ends of the principal scoreline tends to crack, especially if the panel can be reached by the user. The result is that the panel may be freed from the end to fall into the container. This represents a potential problem since the free panel may pass through the pour opening and possibly may be swallowed if the contents are consumed directly from the container.

Where the hinge is small, folded sharply and close to the opening, all of these factors contribute to a potentially dangerous situation.

The pending applications as well as the lanced tab, hinged structure described are representative of those hinge type structures. The present invention represents an improvement over these structures.

SUMMARY OF THE INVENTION

The end structure of the present invention differs from the prior art and the structures above described in that the panel is secured to the end wall by a retaining strip, and the end wall includes beaded formations and coined areas while the panel includes deformations therein to facilitate opening and progressive rupture of the scoreline by an improved tab structure.

The improved end structure of this invention includes an end wall having a scoreline which defines an opening panel. Attached to the end wall by a rivet or suitable means, and in a location other than on the panel but on the center line of the end wall, is a longitudinally rigid tab whose opening end overlies the panel and whose lifting end is spaced away from the panel. Thus, the tab remains fixed to the end wall and is not separable upon rupture of the opening.

The scoreline includes a portion located between the rivet and the opening end of the tab, the latter overlying the panel. The tab is in the form of a substantially longitudinally rigid lever which is operative upon lifting one end thereof to initiate rupture of the portion of the scoreline between the opening end and the rivet, the initial pop, so called, by a shearing action. Further lifting of the tab will effect progressive rupture of the soreline. Thereafter, the tab may be raised further to force the panel laterally and downwardly. The principal scoreline terminates in spaced scorelines which form legs located laterally of the rivet so that a retaining strip is formed to one side of the rivet which retains the pour panel to the end wall.

Unlike a hinge, the retaining strip of this invention does not result in a sharp bend of metal but rather in a rolling arc-like bend as the retaining strip is formed during an opening sequence. Rather than forming a sharp bend, a progressive roll is formed during opening, with the panel being retained by the strip and extending downwardly beneath the end wall and spaced axially from the principal scoreline so that the panel is folded downwardly and spaced away from the scoreline. In fact there is no axis around which a sharp fold occurs but rather a progressive rolling permits movement of the panel into the container. The result is avoidance of a sharp bend which tends to promote cracking along the axis of the hinge which holds the panel to the end wall.

In a preferred form of this invention, the pour panel includes a deformation forward and to one side of the rivet and the scoreline and located beneath the opening end of the tab. Surrounding the rivet is a rivet well formed during the rivet forming sequence, the scoreline being located so that a portion thereof is in the rivet well forward of the rivet and constitutes that portion of the scoreline which is initially popped.

While the end structure of this invention may take various forms, an improved tab structure is used which is retained with the end wall, and includes a relatively rigid body member having a lifting end and an opening end with a flap member between the lifting and opening end. The flap member receives an attaching member, preferably in the form of a rivet, and retains the tab on the end wall subsequent to completion of severance of the scoreline by the opening end which preferably includes a blunt nose formed of multiple folds and a center finger.

The tab itself is of sheet material such as tin plate or aluminum sheet, preferably of a zero temper alloy, and the finger at the opening end includes a forward portion and a rearward finger portion positioned slightly below the forward portion.

In an opening sequence, a portion of the opening end of the tab contacts the panel to apply a downward pressure on the panel while the flap lifts upwardly on the rivet thus stressing the portion of the scoreline portion in the rivet well. The stress is a shear type of stress resulting from a combined class 2 and class 1 lever action of the tab during the initial pop phase of an opening sequence. Where the container is under pressure, the pressure cooperates with the class 2 lever action of the tab to initiate the pop by a lifting action on the rivet.

Subsequent to the pop, the tab acts as a class 1 lever to rupture the scoreline progressively in a counterclockwise direction, i.e. from the rivet in a counterclockwise direction along the scoreline towards the retaining strip. This progressive type of scoreline rupture has the advantage of a smooth opening action.

Subsequent to rupture, the tab may be raised further to fold the panel beneath the end wall while the tab may then be pushed flat against the end wall, out of the user's way. The panel is retained by the retaining strip located in spaced relation to the principal scoreline and adjacent to the rivet.

The deformation cooperates with the opening end of the tab, which is formed with a blunt front end in chordal relation to the scoreline, and with the laterally positioned retaining strip to assure proper progressive rupture of the scoreline.

The initial pop is achieved by raising the lifting end of the tab so that the opening end bears against the panel while raising the rivet to place the portion of the scoreline in front of the rivet in shear. This is achieved by that half of the opening end of the tab furthest removed from the deformation so that the portion of the scoreline in the rivet well is popped and fracture starts to progress away from the rivet well in a counterclockwise direction. Thereafter the middle portion of the tab, principally that area beneath the finger, bears downwardly on that portion of the panel adjacent to the junction of the depression and the panel to effect rupture of the scoreline all the way out to an area approximately forward of the rivet. At the same time, the panel starts to tilt downwardly while a portion of the score leg forming the retaining strip is fractured.

In that relative position, the portion of the opening end of the tab overlying the depression is in contact with the depression, the tab end being at an angle of about 40° to 50° with respect to the end wall. As the tab end is raised about 90°, the remainder of the pour opening is formed by progressive rupture of the scoreline and the second score leg starts to rupture to initiate formation of the retaining strip. Further movement of the tab, from the 90° to the 180° position completes formation of the retaining strip, by progressively rolling back the strip as the second leg is ruptured resulting in orientation of the panel in a generally vertical position but spaced away from the principal scoreline. The tab may then be pushed back against the end wall and is retained there while the panel is held by the separately formed retaining strip.

It will be apparent from the following detailed description that a much improved retained tab and tear strip end structure is disclosed, and the further features and advantages thereof may be best understood by reference to the following description taken in connectiion with the accompanying drawings.

DESCRIPTION OF THE DRAWINGS

FIG. 1 is a view in perspective of the end structure of the present invention;

FIG. 2 is a view in perspective similar to FIG. 1, with the tab removed, showing the end structure of this invention;

FIG. 3 is an enlarged view in persepctive of a portion of the end structure as shown in FIG. 2, illustrating the button stage;

FIG. 4 is an enlarged view, in perspective and partly in section, of the end structure as shown in FIG. 3;

FIG. 5 is an enlarged view in perspective of the underside of the tab in accordance with this invention;

FIG. 6 is an enlarged view similar to that of FIG. 5, with portions thereof broken away;

FIG. 7 is an enlarged view in perspective of the upper side of the tab in accordance with this invention;

FIG. 8 is an enlarged fragmentary view, with the tab dotted in, showing the relative position of the parts during the initial pop phase of an opening sequence of the end structure of this invention;

DETAILED DESCRIPTION OF THE INVENTION

Figure 9:
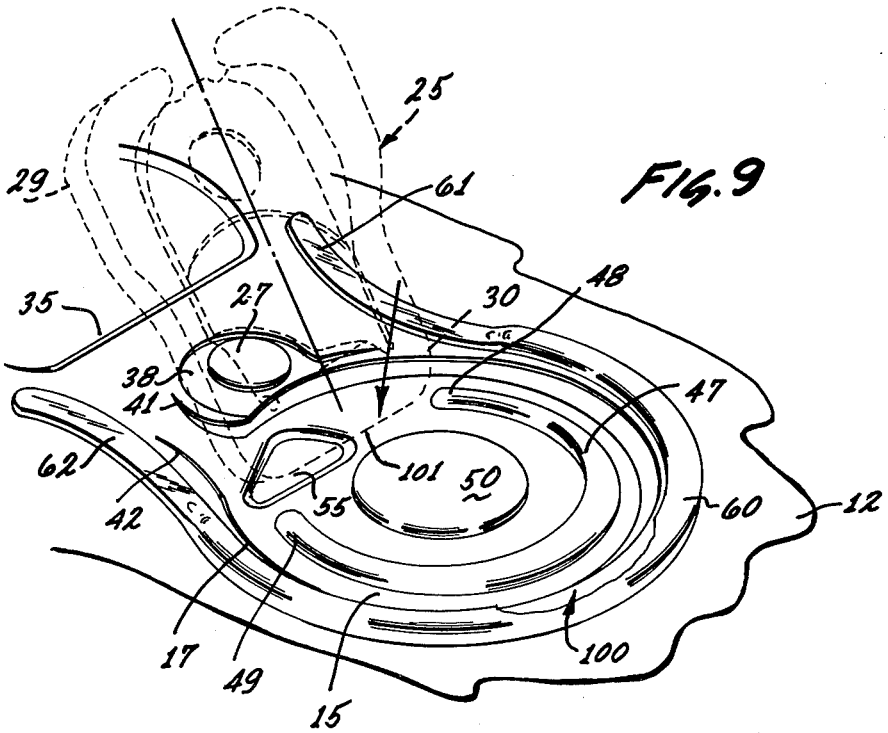
FIG. 9 is a view similar to FIG. 8, illustrating the relative position of the parts during progressive rupture of the scoreline, in accordance with this invention.

Referring to the drawings which illustrate a preferred form of the invention, FIGS. 1 and 2 show a container end structure 10 formed of sheet material, such as aluminum alloy and the like. The end structure includes a central wall or panel portion 12 having a pour panel 15 therein, the pour panel being at least partially circumscribed by a scoreline 17 which is ruptured to form a pour opening in the end structure.

The end wall 12 of the container includes a chuck wall 18 which terminates in a flange 19 which is vertically above the central panel 12 while a groove 20 is at the base of the chuck wall, the groove being positioned vertically below the center panel 12. The end structure 10 may be attached to a container in the usual manner through seaming the flange 19.

As illustrated, the pour panel 15 is adjacent to and close to the chuck wall 18 and located generally on the center line of the central wall 12. If desired, the pour panel may be offset as described in Ser. No. 608,044.

As illustrated in FIG. 1, the easy-opening end structure 10 includes tab 25 affixed to the central wall 12, as opposed to the panel 15, by an integral rivet 27, as shown. the tab includes a longitudinally rigid body member generally designated 28, and a lifting end 29 and an opening end 30. The central wall also includes a finger well 35 positioned therein essentially below the lifting end 29 of the tab 25. In this way, the user may conveniently insert a finger underneath the lifting end of the tab during an opening sequence to be described below.

Referring now to FIGS. 3 and 4, the noraml cross-sectional thickness of the sheet material of the end wall is approximately 0.013 inches, and in the area surrounding the rivet, shown in button form 37, there is a rivet well 38 whose cross-section is approximately 0.009, the rivet well representing a coined section formed during the rivet forming operation. The scoreline 17 is generally circular in shape, as shown, and includes a portion 40 forward of the rivet and located in the rivet well. Cooperating with the scoreline 17 are two separate score legs 41 and 42, each separate from the scoreline 17 and functioning to form a retaining strip 44. The legs are formed by scoring the metal and each of the scores is of progressively increasing residual from about points 41*a* and 42*a* to the respective ends of the score. In other words, from point 41*a* and point 42*a* to the ends of the score legs, the depth of the score progressively becomes less. The portion 44 of the end wall between the adjacent scores 41 and 42 forms a retaining strip to retain the panel 15 on the end wall subsequent to rupture of the scoreline 17. It is for this reason that the ends of the scores have a tapering score profile which gradually decreases towards the terminal end of each of the legs. As illustrated, score 41 is curved around the outer periphery of the rivet well 38 while the ends of the scores 41 and 42 are positioned laterally of the rivet and extend rearwardly towards the finger well so that the retaining strip 44 is located approximately laterally of the rivet.

Located laterally of the rivet and on a side thereof opposite the retaining strip 44 is a coined transition zone 45 which communicates with the rivet well and overlies a portion of the scoreline adjacent to the portion of the scoreline 40 located in the rivet well. As shown in FIG. 4, the cross-sectional dimension of the material of the end wall gradually increases from 0.009 inches at the rivet well to approximately 0.013 inches in the area outside of the coined transition zone. The purpose of coining in this area is to protect that portion of the scoreline adjacent the rivet well and to avoid a sharp change in cross-sectional dimensions of the end structure which may present score integrity problems. It has been found that by use of coined transition zone, the premature and inadvertant fracture of the scoreline is substantially eliminated.

The pour panel 15 includes a raised rib 47 formed therein and extending approximately 245° around the panel and in spaced relationship to the scoreline 17. The rib terminates in free ends 48 and 49 which are spaced from each other and oriented so as to face toward the rivet well 38, as illustrated. Located in the center of the rib 47 in the panel 15 is a raised panel 50, the center line of which is approximately on the center line of the rivet. The raised bead 47 and the raised panel 50 are used principally to take up excess metal formed during the scoreline forming operation.

Located adjacent to the end 49 of the rib 47 is a generally triangular or kidney shaped depression indicated at 55, the depression being generally in line with the retaining strip 44 and located laterally of the rivet. This triangular depression, oriented with the long leg facing away from the rivet, cooperates with the tab in an opening sequence as will be described hereinafter. The rib 47 and the raised panel 50 also operate to stiffen the pour panel, an advantage during the opening sequence.

Cooperating with the scoreline 17 and formed in the end wall 12 is an end wall bead 60 which surrounds a substantial portion of the scoreline and which terminates in coined legs 61 and 62, each leg being spaced on one side of the rivet and extending rearwardly beyond the rivet, as illustrated. The contour of the end wall bead 60 in the vicinity of leg 62 follows generally the contour of the scoreline in the area laterally of the rivet and follows the contour of score legs 42 and 42*a*. As illustrated in FIG. 4, the coined bead legs include an upper surface 63 which is of reduced cross-sectional material as compared to the portion of the bead extending downwardly and forming the side walls of each of the panel bead legs 61 and 62. The coined legs 61 and 62 are located on each side of the rivet and rivet well and operate to protect the area forward of and to the rear of the rivet when a container is under pressure, the coined area operating to relieve the tension and stress created as a result of internal pressure within the container.

Referring now to FIGS. 5 – 7, the improved tab 25 of this invention is formed of sheet material, such as aluminum alloy sheet or the like, in the usual fashion through a progressive die set which performs a series of operations on tab sheet stock. The tab, formed of a single sheet of material, includes two longitudinally extending legs 66 and 67, interconnected at the rearward end of the tab by a web of material generally designated 68 and at the forward end by a cross-member 70.

To the rear of the opening end 30 of the tab is a flap member 72 extending rearwardly from the cross-member 70 towards the lifting end. The flap 72, which constitutes an extension of the cross-member 70, forms a separate narrow web of material having an aperture 74 through which the rivet 27 passes to secure the tab in place on the central wall 12. The side walls 76 and 77 of the flap are spaced from the adjacent inner surfaces of legs 66 and 67 and the flap is likewise spaced from the web 68.

The legs 66 and 67 are curled for safety and for stength in order to provide a longitudinally rigid tab. As illustrated, the flap 72 is interconnected to the cross-member 70 by a bridging web 79 which is curved as illustrated so that the flap extends slightly below the web 68. The lifting end 29 of the tab includes a knotch 80 resulting from the severance of a narrow connecting web used to hold the tab during its formation by a progressive die set, as is well known. The ends 81 and 82 are curled and radiused to prevent contact with residual metal in the notch.

The opening end 30 of the tab is formed of multiple layers of sheet metal for strength purposes, one layer constituting the face 83 of the cross-member and continuing to the underside of the tab to form a finger 85 which is curled under to form an intermediate web 86 having spaced fingers 87 and 88 which are received between the folds of the curl forming the side legs 66 and 67. The intermediate layer 86 includes a free end 90 which is curled under slightly to prevent the free end of the intermediate layer from cutting through the finger 85.

As is apparent from FIGS. 5 – 7, the tab structure overall includes a blunt nose which has a finger 85 centrally located and in alignment with the aperture 74 of the flap 72. The web 68 includes an indexing aperture 91 which is used as an indexing reference during manufacture of the tab by the progressive die set.

In general, the sequence for the manufacture of the end structure in accordance with present invention involves 5 stations, the first being the bubble station in which the bubble, later to be formed into a rivet, is initially formed. In the second station, the bubble is transformed into a button, illustrated in FIGS. 2 – 4, while in the third station, the various ribs and formed portions of the end wall and coining operations take place. In the fourth station, the scoreline and score legs are placed in the end while at the fifth station, the tab is assembled and staked in place on the end structure.

Referring to FIG. 8, it will be seen that the opening end 30 of the tab is basically in a chordal relation with respect to the scoreline 17 with the corners 93 and 94 of the forward end of the tab oriented essentially between the ends 48 and 49 of the pour panel bead 47 and rearwardly of the raised panel 50. Also, the corner 94 of the opening end of the tab essentially overlies the depression 55 which is located forward of the retaining strip 44. Thus, the finger 85 of the tab is basically in alignment with the center line of the rivet 27 and the raised panel 50 in the center of the pour panel.

As the lifting end 29 of the tab is raised, at the start of an opening sequence, there is some idle lift provided and the opening end 30 of the tab bears downwardly on the underlying portion of the pour panel 15 while the portion of the end structure in the area of the rivet well 38 is raised since the flap 72 lifts upwardly through the rivet 27. The principal pressure area is that half of the opening end of the tab remote from the depression 55, i.e. the portion of the tab between the corner 93 and midway of the finger 85. Accordingly, the portion 40 of the scoreline immediately forward of the rivet is placed in a shear condition by virtue of the simultaneous effect of pushing down on the pour panel and lifting on the rivet. This type of operation during the initial opeing sequence, the "initial pop" phase, is advantageous since the initial opening sequence takes advantage of any pressure within the container.

As indicated in FIG. 8, the initial pop of the scoreline occurs at portion 40 of the scoreline to release any internal pressure, the tab being positioned over that portion of the scoreline which is initially fractured.

Referring to FIG. 9, as the tab is raised further to a position of approximately between 30 and 45°, the scoreline 17 is progressively ruptured and score leg 41 is also ruptured, the scoreline rupture continuing in a clockwise direction through the transition area 45 and out to approximately the area indicated by the arrow 100. Subsequent to the initial pop, the fracture of the scoreline between the area 40 and the area 100 occurs by virtue of the center portion of the opening end 30 of the tab, especially the finger area bearing against the underlying portion of the pour panel, that is the portion 101 adjacent to and forming the junction between the depression 55 and the panel. In the relative position illustrated in FIG. 9, a substantial portion of the scoreline has been fractured and the quadrant of the pour panel opposite the retaining strip 44 has started to rotate downwardly.

Depression 55 cooperates in the opening sequence to assure the progressive rupture of the scoreline in a clockwise direction by permitting half of the opening end of the tab to bear against the pour panel until a substantial portion of the scoreline, approximately to section 100, has been fractured and the panel has started a downward rotation.

Figure 10:
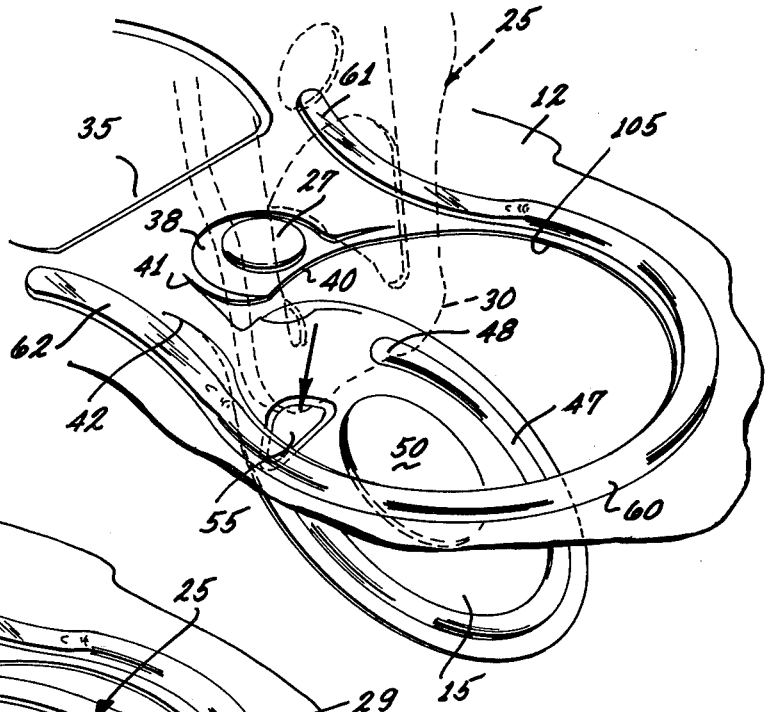
FIG. 10 is a view similar to FIG. 9, illustrating the relative position of the parts with the tab raised approximately to the vertical position, in an opening sequence in accordance with the present invention.

Continued lifting of the lifting end 29 of the tab, as illustrated in FIG. 10, completes the progressive rupture of the scoreline by virtue of the fact that corner 94 of the tab now rides in depression 55 to effect continued rupture of the scoreline and the score leg 42 which cooperates with leg 41 to form the retaining strip 44 laterally of the rivet and to the rear of the depression 55 for retaining the panel 15 to the end wall.

As illustrated in FIG. 10, the retaining strip 44 is progressively rolled as score leg 42 is fractured and as the panel starts to rotate downwardly. Especially significant is the absence of any sharp bend. In actual practice, the rolling action follows the fracture of the second score leg 42 and there is no true axis of rotation but a progressive rolling which follows the fracture in leg 42. As shown, the panel is in the process of being folded away from and laterally to the side of the opening 105 formed in the end wall. In the normal sequence, the portion of the end wall beneath the corner 93 of the opening end of the tab moves out of contact with the underside of the tab such that the principal contact between the tab and the end wall is between the corner 94 and the portion of the tab adjacent thereto, and the depression 55 for that portion of the opening sequence in which the scoreline is ruptured from the area indicted at 100 to the score leg 42.

The purpose of the depression 55 is to assure that the tab maintains contact with the portion of the pour panel underlying the corner 93 and the finger 85 until a sufficient portion of the scoreline is ruptured at which time the other corner of the tab is operative to continue the progressive rupture of the scoreline in a smooth sequence.

The flap 72 bends along an axis which is essentially at the junction of the finger 85 and the bridging web 79, the axis being aligned essentially with the portion 40 of the scoreline. In this way, substantial upward movement of the rivet is prevented. If there is substantial upward movement of the rivet, the shear forces needed for scoreline fracture are not generated.

Figure 11:
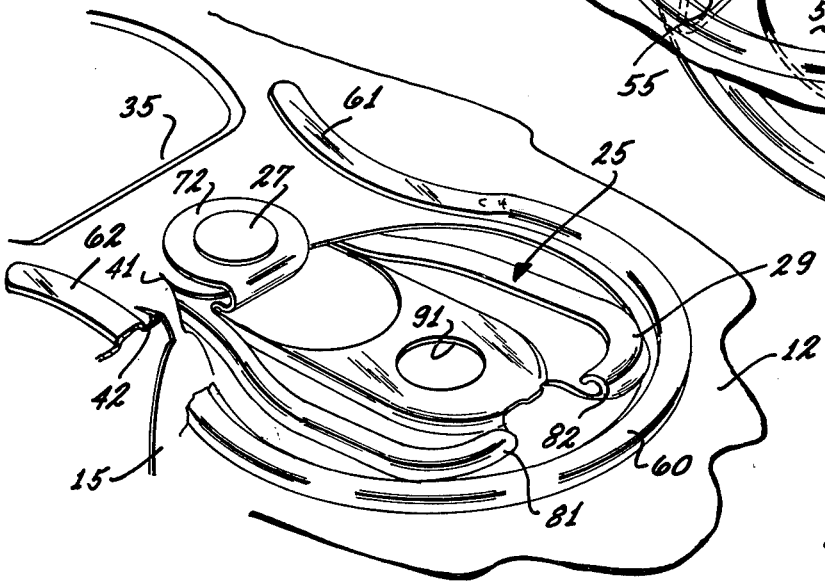
FIG. 11 is a view similar to FIG. 10, with the tab in full lines, showing the relative position of the tab at the completion of an opening sequence and before it is folded back on the end wall, in accordance with this invention.

As illustrated in FIG. 11, the tab may be folded over to essentially a 180° position such that the nose or opening end of the tab is completely underneath the end wall in order to sweep the panel laterally of the opening in the relative position illustrated. To prevent the tab from being pushed through the opening of the end wall, the transverse dimension of the lifting end tab is larger than the opposed open area in the opening formed in the end wall. Thereafter, the tab may be returned to essentially its original position and retained on the end wall by the rivet 27. Since the dimension from the center line of the rivet to the front end of the tab is relatively small, a substantial open area of the pour opening exists and the tab does not interfere with the pouring of the container contents.

The advantages of the end structure in accordance with the present invention, as described above, in addition to providing an ecology type of structure and the convenience of an easy-opening container, also includes the provision of an end structure which may be made in a five station press, and a structure which performs well under the severe tests of the industry. Several different types of tests are conducted, for example, end buckle, recovery, bulge, venting, tab accessibility, initial score break pressure, opening force, tab detachability, and the like. The tests above described are for the purpose of establishing the performance of the end structure in actual packaged conditions, having in mind that the end wall may be used to package a variety of products.

End buckle is principally a pressure test which determines the deflection characteristics of the end by monitoring the pressure at which the end in the area 110 (FIG. 1) is permanently deflected because of pressure. In this test, the container is exposed to pressure sufficient to deflect the end structure and normally occurs at the interior section of the intermediate wall 20 and the top structure such that it is raised above the flange 19. For beer products and soft drinks, the acceptable performance is buckle at not less than 90 pounds per square inch and 82 pounds per square inch, respectively. In other words, when exposed to 90 pounds per square inch, the end should not buckle sufficiently to be permanently deflected because of pressure. End structures in accordance with the present invention perform satisfactorily up to a pressure of 93 pounds per square inch and above to about 100 pounds per square inch without objectionable end buckle.

Bulge is a test which determines the pressure, as the pressure within the container is increased, which causes the high point of the tab to be even with the chime. This test is normally performed before the recovery test to be described. Normally, the container is pressurized slowly to 84 pounds per square inch, and the location of the high point of the tab is monitored, relative to the increasing pressure, to determine the point at which the highest point on the tab is above the chime. In this test, at 50 psi, the high point of the tab is even with the chime, and any container end structure which exhibits a higher pressure is acceptable. End structures in accordance with the present invention have provided a bulge characteristic of 70 pounds per square inch, substantially above test requirements.

Recovery is a test to determine at what pressure the tab will fall below the chime after the pressure within the container has been increased to 84 pounds per square inch, released, increased to 84 pounds per square inch a second time. Thus, the test is performed after the container has been once exposed to pressure at 84 pounds per square inch and is conducted during the second pressurization stage. The pressure needed to raise the high point of the tab above the chime after the second pressurization indicates the recovery characteristics of the end structure. A figure of 25 pounds per square inch is considered acceptable for this test. End structures in accordance with the present invention indicated a recovery at 40 pounds per square inch substantially higher than the test requirement.

The vent test is a determination of the pressure at which the pour panel will be freed of the container totally and instantly during an opening sequence. In this test, a container is pressurized to various given pressures and the containers are opened to determine that pressure at which the pour panel will be torn loose of the end structure. An acceptable test pressure is 90 pounds per square inch minimum. End structures in accordance with the present invention have performed satisfactorily at pressures above 110 psi, well in excess of the test requirements. The coined legs materially assisted performance in this test.

The initial opening force, or initial score break pressure at 0 psi of can pressure, needed to break the scoreline is a measure of the ease with which the scoreline may be initially ruptured. End structures in accordance with the present invention initially ruptured at a force of about 4.2 pounds. A companion test is the force needed to raise the tab to 90° after the initial pop and during an opening sequence. Tests of end structures in accordance with the present invention indicated a force of approximately 5.8 pounds.

Another test which is performed is to determine the extent to which the tab will remain on the end structure subsequent to opening of the end structure. This is performed by folding the tab back and forth, a movement from the normal tab position through the opening sequence and back to the normal position constituting one cycle. Tests of structures in accordance with the present invention indicated that the tab would withstand approximately 2.4 cycles, after opening, before becoming detached.

Also important is the ease with which the consumer may insert a finger beneath the free end of the tab, this characteristic being defined as tab accessibility and is measured between the bottom of the finger well to the underside of the tab curl. The industry generally utilizes a figure between 0.070 and 0.080 inches. The structure in accordance with the present invention satisfies that test as well.

The above data indicate that the end structure fabricated as described satisfactorily performs with respect to the various conditions encountered in actual packaging of products, and adequately meets the test requirements and performance requirements of the industry.

In addition to the above, the position of the end wall bead 60 (FIG. 3) and the relationship of the scoreline to the end bead (FIG. 11) indicates that the bead not only provides stiffening in the opening operation but also a measure of protection against the raw edge of the scoreline subsequent to its rupture.

Tests of the pouring characteristics of the end structure indicate that is is comparable to the pouring characteristics of bottled beverages.

As a principal objective of the present invention is to provide a so-called ecology end in which neither the tab nor the scored segment forming the pouring opening will be removed or separated from the can end after the rupture of the scoreline to form the pouring opening, it is desirable that the tab should not be easily removed merely by a user bending the tab back and forth once or twice after the pouring opening has been formed. This feature can be provided by forming the tab of a "dead soft" aluminum alloy for the tab. For example, zero tempered aluminum alloy 5082, or an equivalent material, of 0.018 inch thickness may advantageously be used for the tab. Normally this particular alloy is considered too soft for use as tab stock. However, by virtue of the strength in the tab, i.e. multiple layers and rolled sides, this alloy can be used and will substantially increase the number of times the tab can be bent back and forth after the pouring opening is formed. Where the tab is formed of a soft aluminum alloy, preferably the residuals of the scoreline should be in the range of 0.0038 and 0.0046 inches.

The use of a retaining strip which is progressively rolled to avoid sharp bends substantiall reduces the possibility of the panel separating from the end wall while locating the panel away from the scoreline. The absence of a hinge or a fixed axis of rotation by the use of a retaining strip which is progressively rolled between score legs substantially improve the reliability of the end structure.

Various modifications may be made, for example, the portion of the panel bead 60 near the chuck wall may be removed so as to place the scoreline 17 closer to the chuck wall. In this case separate panel beads and coined legs may be used.

Another modification is the scoreline configuration which may be oval or U-shaped with essentially a straight leg forward of the rivet and the formation of score legs as described.

Even if modified as suggested, the end structure performs as indicated and includes all of the advantages described.

Overall it is believed that the structure above described not only meets the requirements of the industry from a performance standpoint, but can be fabricated on tooling easily fitted to current equipment while providing an ecology end in which there are no loose parts which can contribute to the litter problem.

It will be apparent to those skilled in the art that various modifications and alterations may be made, for example, the hinge may be placed on the other side along with the depression such that instead of opening to the side indicated in the drawings, the panel will open to other side. Oval type openings may be used rather than circular. The rivet and tab may be oriented on a center line or offset to one side of the end structure, as desired. Thus, various modifications may be made, as will be apparent from the above, without departing from the invention as set forth in the appended claims.

I claim:

1. An easy-opening end structure for use with a container comprising an end wall of sheet material having means for attaching said end wall to a container, a scoreline in said end wall defining a panel which is at least partially removable to form a pour openin in said end wall, a tab affixed to said end wall and including a lifting end and an opening end, rivet means for attaching said tab to said end wall such that the opening end of said tab overlies said panel, a portion of said scoreline extending between said rivet means and said opening end of said tab, score legs cooperating with said scoreline and extending away from said scoreline, said score legs being located laterally of said rivet and beneath said tab to form a retaining strip which interconnects said panel to said end wall, and said tab being formed of a single sheet of material.

2. An easy-opening end structure as set forth in claim 1 further including bead means in said end wall surrounding at least a portion of the scoreline forward of the opening end of said tab.

3. An easy-opening end structure as set forth in claim 1 further including coined bead segments in said end wall and located adjacent to said tab means.

4. An easy-opening end structure as set forth in claim 1 wherein said opening end of said tab includes a generally blunt nose located forward of said rivet and positioned forward of said scoreline.

5. An easy-opening end structure as set forth in claim 4 wherein said blunt nose of said tab includes a finger extending downwardly against said panel.

6. An easy-opening end structure as set forth in claim 2 wherein said panel includes bead means terminating in free ends, said panel bead means spaced inwardly of said scoreline.

7. An easy-opening end structure as set forth in claim 1 wherein said panel includes means forming a deformation located forward of said rivet and in alignment with said retaining strip.

8. An easy-opening end structure as set forth in claim 6 wherein said panel includes a deformation located forward of the rivet and adjacent the free end of said panel bead means.

9. An easy-opening end structure as set forth in claim 1 wherein said scoreline is generally circular in shape and said tab including an opening end in chordal relation to said scoreline.

10. An easy-opening end structure as set forth in claim 3 wherein said score legs terminate between said rivet and one of said coin bead segments.

11. An easy-opening end structure as set forth in claim 9 wherein said panel includes deformation means therein located beneath the opening end of said tab.

12. An easy-opening end structure as set forth in claim 1 wherein said panel includes stiffening means therein.

13. An easy-opening end structure as set forth in claim 6 further including a raised bead positioned in said panel and forward of the opening end of said tab.

14. An easy-opening end structure for use with a container comprising:

an end wall of sheet material having means for attaching an end wall to a container, a scoreline in said end wall defining a panel which is at least partially removable to form a pour opening in said end wall, a tab affixed to said end wall and including a lifting end and an opening end, rivet means attaching said tab to said end wall such that the opening end of said tab overlies said panel, a portion of said scoreline extending between said rivet means and said opening end of said tab, means forming spaced score legs cooperating with said scoreline and extending away from said scoreline, said score legs being located laterally of said rivet means and forming a retaining strip which interconnects said panel to said end wall to form a retained panel, said tab being operative to effect rupture of said portion of said scoreline and progressive rupture of the remainder to form a retained panel attached to said end wall and positionable below the end wall, and said end structure having the following characteristics:

a. End buckle of greater than 90 pounds per square inch, b. Recovery of greater than 25 pounds per square inch, c. Bulge of greater than 50 pounds per square inch, and d. Tab accessibility as measured between the underside of the opening end of the tab and the opposed end wall of at least 0.070 inch.

15. An easy-opening end structure as set forth in claim 14 wherein said tab is foldable back towards said end wall subsequent to formation of the pour opening and retained by said rivet while said panel is retained by a retaining strip.

16. An easy-opening end structure as set forth in claim 14 wherein said end wall includes bead means adjacent at least a portion of said scoreline.

17. An easy-opening end structure as set forth in claim 14 wherein said panel includes bead means therein adjacent to at least a portion of said scoreline and spaced therefrom.

18. An easy-opening end structure as set forth in claim 14 wherein said end wall includes a finger well located beneath the lifting end of said tab.

19. An easy-opening end structure as set forth in claim 14 wherein said end wall includes bead means adjacent to and spaced from at least a portion of said scoreline.

20. An easy-opening end structure set forth in claim 17 wherein the bead means in said panel includes spaced ends, and depression means in said panel adjacent one end of said bead means.

21. An easy-opening end structure as set forth in claim 14 wherein said tab includes an opening end formed of multiple layers of sheet material.

22. An easy-opening end structure as set forth in claim 21 wherein said tab includes side arms interconnecting the lifting and opening end, and one of said layers including spaced ears oriented in alignment with said side arms.

23. An easy-opening end structure as set forth in claim 14 wherein said panel includes bean means having free ends spaced from a portion of said scoreline, said rivet means being surrounded by a rivet well of a material of reduced cross-section, said portion of said scoreline passing through said rivet well, coined means forming a transition zone extending laterally of said rivet and overlying a portion of the scoreline laterally of said rivet, depression means in said panel forward of said retaining strip and between the ends of said panel bead means, and said end wall including bead means terminating in coined end sections and surrounding a portion of said scoreline, said coined sections being spaced on each side of said rivet.

24. An easy-opening end structure for use with a container comprising an end wall of sheet material having means for attaching said end wall to a container, a scoreline in said end wall defining a panel which is at least partially removable to form a pour opening in said end wall, a tab affixed to said end wall and including a lifting end and an opening end, rivet means for attaching said tab to said end wall such that the opening end of said tab overlies said panel, a rivet well of reduced thickness sheet material surrounding said rivet, a portion of said scoreline being located in said rivet well between said rivet and said opening end of said tab, a transition coin zone extending from said rivet well and overlying a portion of said scoreline adjacent to said rivet well, said panel including a deformation located laterally of said rivet and beneath the opening of said tab, means forming a retaining strip interconnecting said panel to said end wall and located on the side of the rivet opposite said transition coin zone, and said tab being operative upon lifting of the lifting end to rupture the portion of the scoreline in said rivet well and to effect progressive rupture of said scoreline and to form said retaining strip by bearing against said panel and said deformation.

25. An easy-opening end structure for use with a container comprising an end wall of sheet material having means for attaching the end wall to a container, a scoreline in said end wall defining a panel which is at least partially removable to form a pour opening in said end wall, a tab affixed to said end wall and including a lifting end and an opening end, rivet means for attaching said tab to said end wall such that the opening end of the tab overlies said panel, a portion of the scoreline extending between said rivet means and said opening end of said tab, means forming a retaining strip located laterally of said rivet and rearwardly of said scoreline to hold said panel to said end wall after rupture of said scoreline, means forming a transition coin zone located on the side of said rivet opposite said retaining strip and overlying a portion of the scoreline adjacent to said rivet, and said tab being operative upon raising of the lifting end to effect rupture of said portion of said scoreline and to effect progressive rupture of the remainder of said scoreline thereby to form an opening in said end wall and to form said retaining strip and to retain both said panel and said tab.

26. An easy-opening end structure for use with a container comprising an end wall of sheet material having means for attaching the end wall to a container, a scoreline in said end wall defining a panel which is at least partially removable to form a pour opening in said end wall, a tab affixed to said end wall and including a lifting end and an opening end, said tab formed of a single sheet of an aluminum alloy having zero temper and provided with longitudinally extending stiffening and reenforcing ribs, a mounting ear forming an integral part of said tab, rivet means for attaching said mounting ear to said end wall such that the opening end of the tab overlies said panel, a portion of the scoreline extending between said rivet means and said opening end of said tab, means forming a retaining strip located laterally of said rivet to hold said panel to said end wall after rupture of said scoreline, and said tab being operative upon raising of the lifting end to effect rupture of said portion of said scoreline and to effect progressive rupture of the remainder of said scoreline, thereby to form an opening in said end wall and to form said retaining strip and to retain both said panel and said tab to said end wall, the zero temper of said alloy permitting the tab to be subject to repeated bending movements without separation from the end wall.

* * * * *